US011448027B2

(12) United States Patent
Al Daif et al.

(10) Patent No.: US 11,448,027 B2
(45) Date of Patent: Sep. 20, 2022

(54) ACID WASH SYSTEM FOR WIRELINE AND SLICKLINE

(71) Applicant: SAUDI ARABIAN OIL COMPANY, Dhahran (SA)

(72) Inventors: Mohammed Y. Al Daif, Al Qatif (SA); Ahmed A. Al Jaafari, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/993,621

(22) Filed: Aug. 14, 2020

(65) Prior Publication Data

US 2022/0049565 A1 Feb. 17, 2022

(51) Int. Cl.

| | |
|---|---|
| ***E21B 27/02*** | (2006.01) |
| ***E21B 43/27*** | (2006.01) |
| ***E21B 37/06*** | (2006.01) |
| ***E21B 37/08*** | (2006.01) |
| ***E21B 41/00*** | (2006.01) |
| ***E21B 47/09*** | (2012.01) |

(52) U.S. Cl.

CPC ..... *E21B 27/02* (2013.01); *E21B 37/06* (2013.01); *E21B 37/08* (2013.01); *E21B 41/0078* (2013.01); *E21B 43/27* (2020.05); *E21B 47/09* (2013.01)

(58) Field of Classification Search

CPC ..... E21B 27/02; E21B 47/09; E21B 41/0078; E21B 37/06; E21B 37/08; E21B 43/27

See application file for complete search history.

(56) References Cited

U.S. PATENT DOCUMENTS

| | | | | |
|---|---|---|---|---|
| 5,101,900 | A | 4/1992 | Dees | |
| 6,230,822 | B1 * | 5/2001 | Sullivan | E21B 12/02 175/40 |
| 6,520,255 | B2 | 2/2003 | Tolman et al. | |
| 7,503,404 | B2 | 3/2009 | McDaniel et al. | |
| 9,074,121 | B2 | 7/2015 | Dyer | |
| 2002/0007949 | A1 * | 1/2002 | Tolman | E21B 33/124 166/305.1 |

(Continued)

FOREIGN PATENT DOCUMENTS

| | | | |
|---|---|---|---|
| AU | 740142 | B2 | 11/2001 |
| EP | 2192262 | A1 | 6/2010 |
| WO | 2008007110 | A1 | 1/2008 |

OTHER PUBLICATIONS

International Search Report and Written Opinion issued in Application No. PCT/US2020/051447, dated May 6, 2021 (14 pages).

*Primary Examiner* — Abby J Flynn
*Assistant Examiner* — Yanick A Akaragwe
(74) *Attorney, Agent, or Firm* — Osha Bergman Watanabe & Burton LLP

(57) ABSTRACT

A system for acid treating a section of a well includes a wireline or slickline extending from a surface of the well into the well and a bailer tool assembly attached to an end of the wireline or slickline. The bailer tool assembly includes a first piston positioned in a first piston housing at an axial end of at least one bailer, the first piston being slidable through the at least one bailer, at least one rotatable nozzle positioned at a lower end of the bailer tool assembly and fluidly connected to a fluid reservoir in the at least one bailer, and a depth indicator tool attached to an upper end of the bailer tool assembly.

18 Claims, 6 Drawing Sheets

(56) References Cited

U.S. PATENT DOCUMENTS

| | | | | |
|---|---|---|---|---|
| 2004/0089450 | A1* | 5/2004 | Slade | E21B 41/0078 166/298 |
| 2006/0081380 | A1 | 4/2006 | Hoffman et al. | |
| 2006/0102336 | A1 | 5/2006 | Campbell | |
| 2010/0155054 | A1* | 6/2010 | Innes | E21B 27/02 166/165 |
| 2014/0318766 | A1* | 10/2014 | Bishop | E21B 29/00 166/250.01 |
| 2014/0318782 | A1 | 10/2014 | Bourque | |
| 2017/0114636 | A1* | 4/2017 | Kruger | E21B 23/00 |
| 2017/0175471 | A1 | 6/2017 | Boleyn, Jr. | |
| 2018/0258724 | A1* | 9/2018 | Massey | E21B 17/06 |

* cited by examiner

ACID WASH SYSTEM FOR WIRELINE AND SLICKLINE

BACKGROUND

Well stimulation operations may include hydraulic fracturing treatments and matrix treatments performed to restore or enhance the productivity of a well. In typical hydraulic fracturing operations, a wellbore may be cased and isolated into one or more zones along a section of the well to be fractured. Perforations may then be formed through the casing or lining into the reservoir formation in the section of the well to be fractured. Perforations may be created, for example, using jet perforating guns equipped with shaped explosive charges, bullet perforating, abrasive jetting, or high-pressure fluid jetting. An engineered fracturing fluid may then be pumped into to a well interval and through the perforations at a pressure and rate sufficient to cause fractures into the formation around the well.

In hydraulic fracturing operations, an acid wash may be performed in a pre-fracturing stage for cleaning perforations (e.g., removing scale or other similar deposits) and/or initiating fissures in the near-wellbore rock. Acid wash fluids may be selected from different acid types, such as acetic, formic, hydrochloric, hydrofluoric, and fluoroboric acids, but are typically formed using hydrochloric acid (HCI) and a blend of acid additives.

Matrix treatments include injecting an acid or solvent at pressures below the fracturing pressure into a well to improve the permeability of the surrounding formation, e.g., by dissolving material plugging formation pores, enlarging pore space, and/or creating new conductive channels through the formation. Matrix treatment fluid may be selected based on the type of formation being treated. Matrix treatment fluids may include an acid preflush, main treating fluid, and overflush. Acids used in matrix treatments may include, for example, HCI, HCI mixtures, such as mixtures with hydrofluoric acid (HF), formic acid, and acetic acid.

Acids are typically sent downhole for well stimulation operations (e.g., for pre-fracturing acid washes and matrix treatments) through an acid injection tool connected at the end of a coiled tubing or drill pipe string. Using either coiled tubing or drill string includes a long rig up or tripping time to perform the operation. In addition, as this operation is performed across target zones which are usually deep (e.g., greater than 2 miles), coil tubing or drill pipe tend to stretch and buckle during tripping, which causes a depth difference between what is read on a trip counter and the actual depth of the acid injection tool. This depth difference can be noticed, for example, if the coiled tubing or drill string tags an obstruction in the wellbore shallower than expected. If acid is injected off depth, the acid treatment may fail in its operation. For example, during acid wash treatments where the acid is expected to be jetted across and clean perforation(s), the acid may not clean the perforation(s) when off depth.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to systems for acid treating a section of a well that includes a wireline or slickline extending from a surface of the well into the well and a bailer tool assembly attached to an end of the wireline or slickline. The bailer tool assembly may include a first piston positioned in a first piston housing at an axial end of at least one bailer, the first piston being slidable through the at least one bailer, a nozzle assembly positioned at a lower end of the bailer tool assembly and fluidly connected to a fluid reservoir in the at least one bailer, wherein the nozzle assembly has at least one rotatable nozzle, and a depth indicator tool having at least one of a casing collar locator and a gamma ray unit attached to an upper end of the bailer tool assembly.

In another aspect, embodiments of the present disclosure relate to downhole tool assemblies that include a first bailer having a first fluid reservoir, a first piston positioned at an axial end of the first bailer and slidable through the first fluid reservoir, a plurality of rotatable nozzles positioned at an opposite axial end of the first bailer from the first piston, and a position indicator selected from at least one of a gamma ray device and a casing collar locator.

In yet another aspect, embodiments of the present disclosure relate to methods of acid treating a section of a well that include sending a bailer tool assembly down a well on a wireline or slickline, where the bailer tool assembly may include a first bailer having a first fluid reservoir, a first piston positioned at an axial end of the first bailer and slidable through the first fluid reservoir, a plurality of rotatable nozzles positioned at an opposite axial end of the first bailer from the first piston, and a position indicator selected from at least one of a gamma ray device and a casing collar locator. Location signals may be received from the position indicator as the bailer tool assembly is sent down the well, and the bailer tool assembly may be positioned at a downhole location based on the location signals. The first piston may then be activated to slide through the first fluid reservoir to push an acid out of the first fluid reservoir and through the plurality of rotatable nozzles to acid treat the downhole location.

Other aspects and advantages will be apparent from the following description and the appended claims.

DETAILED DESCRIPTION

Figure 1:
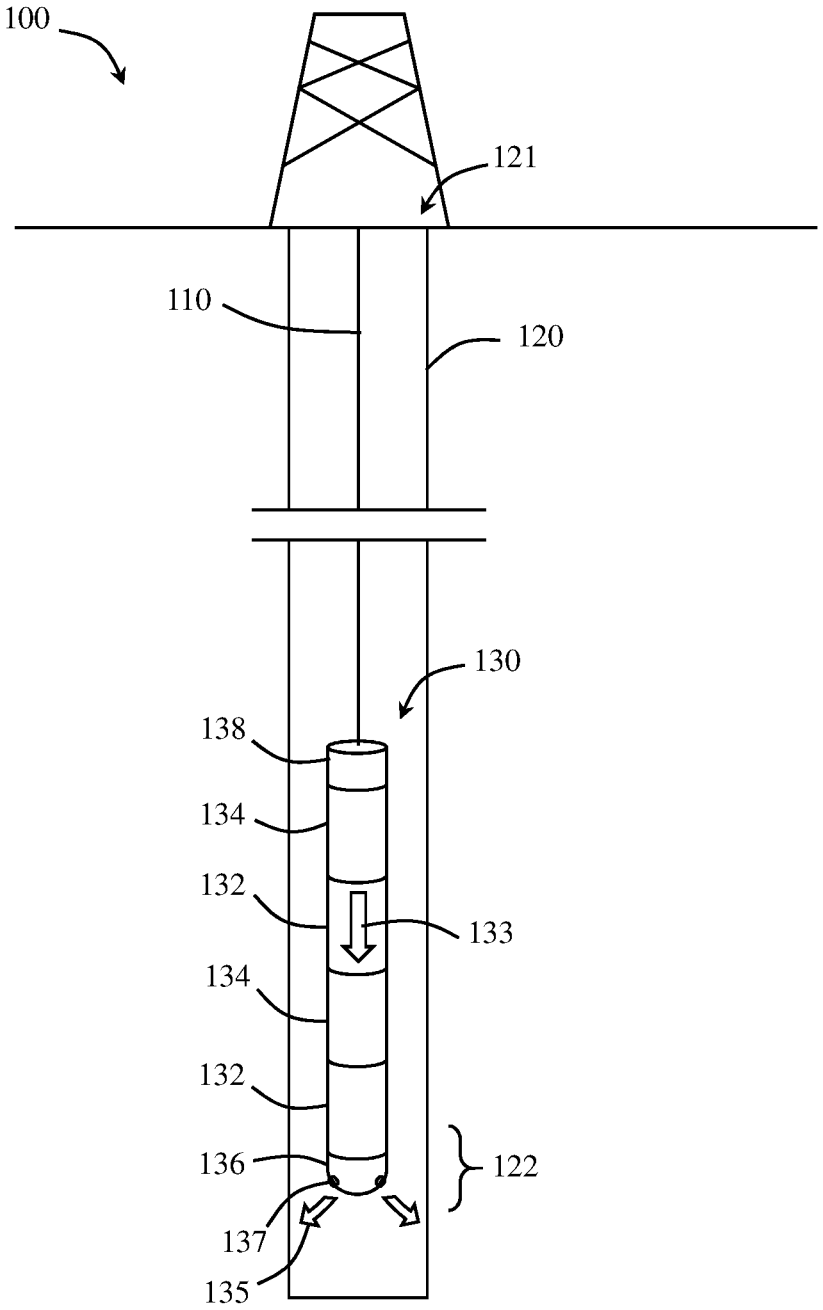
FIG. 1 shows a system according to embodiments of the present disclosure.

As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

In one aspect, embodiments disclosed herein relate to acid distribution systems, which may be used, for example to perform acid wash operations and matrix treatments. Systems disclosed herein may include a bailer tool assembly attached to an end of a wireline or slickline, where the bailer tool assembly may be sent to a designated downhole location on the wireline or slickline to perform an acid operation.

A wireline may include a single-strand or multistrand wire or cable that may be used to run and retrieve tools in a well. A wireline may also include an electrical cable that may transmit data between the connected bailer tool assembly and the surface of the well. Similarly, a slickline may refer to a single-strand wireline that may be used to run and retrieve bailer tool assemblies in a well. When using a slickline, the single strand of wire may be run through a stuffing box and pressure-control equipment at the wellhead to enable slickline operations to be conducted safely in the well. Slicklines typically do not include electric cables. However, in some embodiments, a digital slickline may be used, which may have integral coating for digital two-way communication and may be deployed using a standard slickline unit and pressure control equipment.

FIG. 1 shows an example of an acid distribution system 100 according to embodiments of the present disclosure. The acid distribution system 100 includes a wireline 110 (or slickline may be used) extending from a surface 121 of a well 120 into the well 120. A bailer tool assembly 130 may be attached to an end of the wireline 110 and lowered into the well 120 using the wireline 110. The wireline 110 may include an electrical cable running from the bailer tool assembly 130 to the surface 121 of the well 120, which may be used to transfer electric signals (e.g., electrical commends to activate one or more components in the bailer tool assembly 130) between the bailer tool assembly 130 and the surface 121 of the well 120.

The bailer tool assembly 130 may include at least one bailer 132 having a fluid reservoir filled with an acid. The bailer tool assembly 130 may also include least one piston housing 134 having a piston that is positioned to be slidable through one or more of the bailers 132. When the piston is activated to slide through the bailer(s) 132, the piston may push 133 the stored acid out of the bailer(s) 132 and to a single nozzle assembly 136 positioned at a lower end of the bailer tool assembly 130. The nozzle assembly 136 may be fluidly connected to the fluid reservoir in each bailer 132 provided in the bailer tool assembly 130, such that the single nozzle assembly 136 may provide the outlet for the acid in each of the bailers 132.

The nozzle assembly 136 may include at least one rotatable nozzle 137. Each nozzle 137 may be designed to spray or jet fluid 135 in a designated direction away from the bailer tool assembly 130. In some embodiments, the nozzle(s) 137 may be self-rotating, where fluid flow through the self-rotating nozzle(s) 137 may rotate the nozzle(s) 137. For example, a self-rotating nozzle may include one or more helical channels formed along the interior flow path of the nozzle, where fluid flow through the interior flow path flows through the helical channels to rotate the nozzle. As another example, a self-rotating nozzle may include one or more rotatable blades (e.g., airfoils) positioned in the flow path of the nozzle and connected to the nozzle body, such that fluid flow around the rotatable blades may rotate the rotatable blades and connected nozzle body.

The bailer tool assembly 130 may further include a depth indicator tool 138 attached to an upper end of the bailer tool assembly 130. The depth indicator tool 138 may include at least one of a casing collar locator and a gamma ray unit. A casing collar locator may include a coil-and-magnet arrangement with a downhole amplifier, where magnetic lines in the locator may be distorted when the locator passes a location at which the metallic casing in the well 120 is enlarged by a collar. This distortion results in a change in the magnetic field around a conducting coil in the locator, within which current is induced. The signal may then be amplified and recorded at the surface in the form of a voltage spike, indicating the location of the collar. A gamma ray unit may detect incoming gamma rays from the surrounding formation and well wall, where the length of time between counts is inversely proportional to the logging speed, and thus may be used to determine the depth of the tool.

Using the depth indicator tool 138 to determine precise locations along the well 120, the bailer tool assembly 130 may be sent to a selected section 122 of the well for acid treatment. The acid distribution system 100 may be used, for example, for acid washing a section 122 of the well 120.

Bailer tool assemblies according to embodiments of the present disclosure may utilize different bailer and associated piston configurations to push a stored acid from the bailer through a nozzle assembly at an end of the bailer tool assembly. For example, in some embodiments, a bailer tool assembly may include a single bailer having a single fluid reservoir and a single piston positioned adjacent to the bailer, where the piston is configured to be axially translated through the fluid reservoir of the bailer. In some embodiments, a bailer tool assembly may have multiple bailers, which may be axially connected together in an end-to-end fashion, and a single piston positioned at an axial end of the connected together bailers, where the piston may be configured to be axially translated through each of the bailers. In some embodiments, a bailer tool assembly may have multiple bailers and multiple pistons alternatingly connected together in an axial end-to-end fashion, where each piston may be configured to be axially translated through an adjacent bailer.

Figure 2:
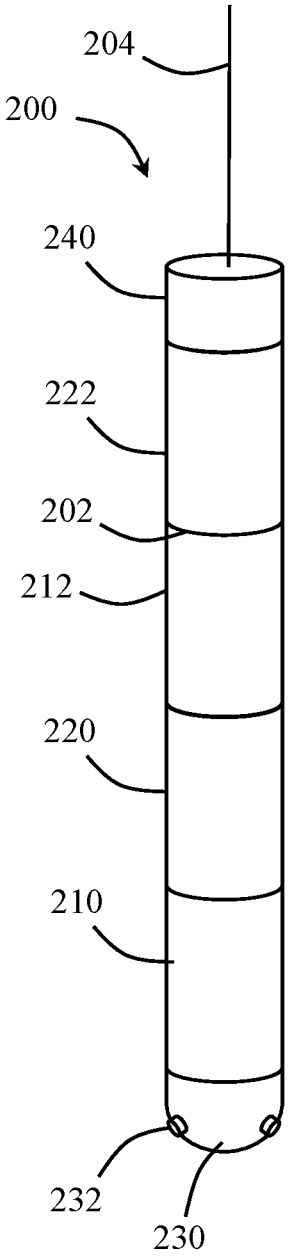
FIG. 2 shows a bailer tool assembly according to embodiments of the present disclosure.
Figure 3:
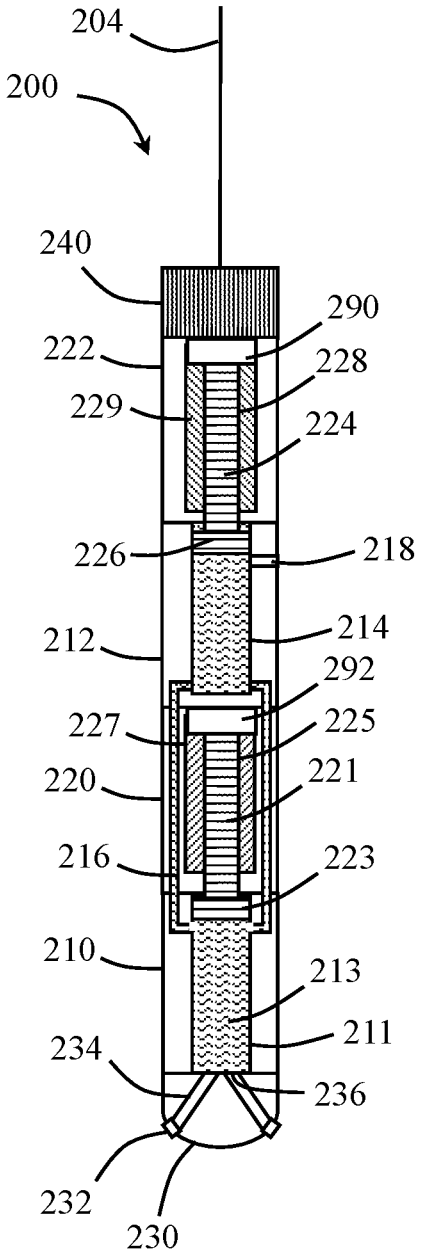
FIG. 3 shows a cross-sectional view of the bailer tool assembly of FIG. 2 along an axial plane intersecting a central longitudinal axis of the bailer tool assembly.

For example, FIGS. 2 and 3 show an example of a bailer tool assembly 200 according to embodiments of the present disclosure utilizing multiple bailers 210, 212 and associated pistons. As shown in the perspective view of FIG. 2, the bailer tool assembly 200 may have a generally tubular body made of alternating tubular piston housings 220, 222 and bailers 210, 212 connected together at threaded connections 202. A nozzle assembly 230 having a plurality of rotatable nozzles 232 may be provided at one axial end of the bailer tool assembly 200, and a depth indicator tool 240 may be provided at an opposite axial end of the bailer tool assembly 200.

The bailer tool assembly 200 may be attached at the axial end opposite the nozzle assembly 230 to a wireline 204. In addition to using the wireline 204 for running the bailer tool assembly 200 to a downhole location, the wireline 204 (via an electrical cable of the wireline 204) may also be used to send and receive electrical signals between the surface of the well and the bailer tool assembly 200.

FIG. 3 shows a cross-sectional view along an axial plane of the bailer tool assembly 200. A first bailer 210 may be positioned axially between the nozzle assembly 230 and a first piston housing 220, where the nozzle assembly 230 may be connected to the lower axial end of the first bailer 210, and the first piston housing 220 may be connected to the opposite, upper axial end of the first bailer 210. The first bailer 210 may include a first fluid reservoir 211 that may be filled with an acid mixture 213, e.g., at least one of acetic acid, formic acid, hydrochloric acid (HCl), hydrofluoric acid (HF), and fluoroboric acids, or a combination of at least one of the aforementioned acids with a blend of acid additives.

Different connection types may be used to attach the first bailer 210 to the nozzle assembly 230 and first piston housing 220. For example, a threaded connection (e.g., using standard API (American Petroleum Institute) thread types) may be used to connect axial ends of the first bailer 210 and first piston housing 220 together and/or to connect the nozzle assembly 230 to an axial end of the first bailer 210. In some embodiments, the nozzle assembly 230 may be connected to the first bailer 210 using one or more interlocking components and/or by welding.

A first piston 221 may be positioned in and extend from a chamber of the first piston housing 220 to be slidable through the first fluid reservoir 211 in the axially adjacent first bailer 210. In the embodiment shown, the first piston 221 may have a piston head 223 positioned in the first fluid reservoir 211. The piston head 223 may have an outer perimeter substantially mating with an inner perimeter of the first fluid reservoir 211. Further, the first fluid reservoir 211 may have a substantially uniform inner perimeter along its axial length, such that when the piston head 223 is slid along the axial length of the first fluid reservoir 211, the piston head 223 may force the acid mixture 213 within the first fluid reservoir 211 to flow away from the piston head 223. The clearance between the outer perimeter of the piston head 223 and the inner perimeter of the first fluid reservoir 211 may be small enough to prevent acid mixture 213 to flow therebetween.

A piston shaft 225 may extend from the piston head 223 through the first piston housing 210 and may be powered by an electrically activated hydraulic chamber 227. The electrically activated hydraulic chamber 227, when activated, may push the first piston 221 through the first fluid reservoir 211 to displace the acid mixture 213 contained in the first fluid reservoir 211. The electrically activated hydraulic chamber 227 may be electrically activated, for example, by sending an electrical signal through the wireline 204. In some embodiments, a piston may be operatively connected to and powered by a motor, which may be selected from downhole motors known in the art, including, for example, downhole electric motors and downhole hydraulic motor.

A second bailer 212 may be positioned axially adjacent to the first piston housing 220 at an axial end opposite the first bailer 210. The second bailer 212 may have a second fluid reservoir 214 containing an acid mixture 213. The acid mixture 213 in the second fluid reservoir 214 may be the same as the acid mixture 213 in the first fluid reservoir 211.

The second bailer 212 and first piston housing 220 may be connected together at adjacent axial ends, for example, using a threaded connection. A second piston housing 222 may be attached to the second bailer 212 at an opposite axial end of the second bailer 212 from the first piston housing 220. The axial ends of the second piston housing 222 and the second bailer 212 may be connected together, for example, using a threaded connection.

A second piston 224 may be at least partially housed in the second piston housing 222 and configured to be slidable through the second bailer 214. In the embodiment shown, the second piston 224 may include a piston head 226 disposed in the second fluid reservoir 214 and a piston shaft 224 extending from the piston head 226 through the second piston housing 222. The second piston 224 may be powered, for example, by an electrically activated hydraulic chamber 229, which may push the second piston 224 through the second bailer 214.

Similar to the design of the first piston 221 and the first fluid reservoir 211, the second piston 224 may have a piston head 226 with an outer perimeter substantially mating with an inner perimeter of the second fluid reservoir 214. The second fluid reservoir 214 may have a substantially uniform inner perimeter along its axial length, such that when the piston head 226 is slid along the axial length of the second fluid reservoir 214, the piston head 226 may force the acid mixture 213 within the second fluid reservoir 214 to flow away from the piston head 226. The clearance between the outer perimeter of the piston head 226 and the inner perimeter of the second fluid reservoir 214 may be small enough to prevent acid mixture 213 to flow therebetween.

One or more fill ports 218 may be provided on the bailer tool assembly 200 and fluidly connected to the first fluid reservoir 211 and/or the second fluid reservoir 214. The fill port 218 may open to an outer surface of the bailer tool assembly 200, such that an acid mixture 213 or other fluid may be filled into the fluid reservoirs 211, 214. A cap may seal the fill port 218 when the bailer tool assembly 200 is in use.

One or more fluid bypass lines 216 may fluidly connect the first fluid reservoir 211 and the second fluid reservoir 214. For example, as shown in FIG. 3, fluid bypass lines 216 may extend from a bottom end of the second fluid reservoir 214, through the first piston housing 220, and to the first fluid reservoir 211. In the embodiment shown, an acid mixture 213 may be filled into the second fluid reservoir 214 via the fill port 218, where the acid mixture 213 may flow from the second fluid reservoir 214 through the fluid bypass lines 216 to fill the first fluid reservoir 214. Acid mixture 213 may be continued to be injected into the fill port 218 until the acid mixture 213 fills the first fluid reservoir 211, the fluid bypass lines 216, and the second fluid reservoir 214.

In some embodiments, at least one fill port 218 may be provided for each bailer 210, 212 in the bailer tool assembly 200. For example, a first fill port (not shown) may be fluidly connected to the first fluid reservoir 211, and a second fill port 218 may be fluidly connected to the second fluid reservoir 214. In such embodiments, each fluid reservoir 211, 214 may be filled with a selected amount of acid mixture 213, which may be the same amount or different amount. Further, in some embodiments, a one-way valve may be positioned along the fluid bypass lines 216, which may allow fluid flow from the second fluid reservoir 214 to the first fluid reservoir 211 and prevent fluid flow in the opposite direction.

Although the bailer tool assembly 200 shown in FIGS. 2 and 3 have two associated piston/bailer assemblies, other embodiments may include more than two associated piston/bailer assemblies (e.g., three or four) that may be assembled and attached in an axial fashion as shown with the two associated piston/bailer assemblies in FIGS. 2 and 3 to form a bailer tool assembly having more than two bailers. The amount of bailers used to form a bailer tool assembly may be selected, for example, based on the volume of acid (or other fluid) that is needed for an acid treatment (or other downhole operation), the volume of fluid that each bailer is capable of holding, and the size and shape (e.g., curvature of any changes in direction) of the well in which the bailer tool assembly is to be used.

The nozzle assembly 230 may be attached to a lower end of the bailer tool assembly 200 such that the rotatable nozzles 232 on the nozzle assembly 230 may be in fluid communication with the first fluid reservoir 211. At least one flow path 234 may extend through the nozzle assembly 230 to fluidly connect the first fluid reservoir 211 to the rotatable nozzles 232. When the nozzle assembly 230 is fluidly connected to the first fluid reservoir 211 in the first bailer 210, the nozzle assembly 230 may also be in fluid communication with the second fluid reservoir 214 via the fluid bypass lines 216 to the first fluid reservoir 211.

In some embodiments, one or more burst discs 236 or one-way pressure relief valves (e.g., a check valve or a spring type valve) may be positioned along the flow paths 234, which may be used to prevent fluid flow through the rotatable nozzles 232 until after the piston(s) are activated. For example, in embodiments having a burst disc 236 (or other pressure relief mechanism), when the acid mixture 213 in the first bailer 210 is compressed to a selected pressure by activation of a piston, the pressure build up may break the burst discs 236 (or valve) to allow the acid mixture 213 to flow out of the rotatable nozzles 232.

Figure 4:
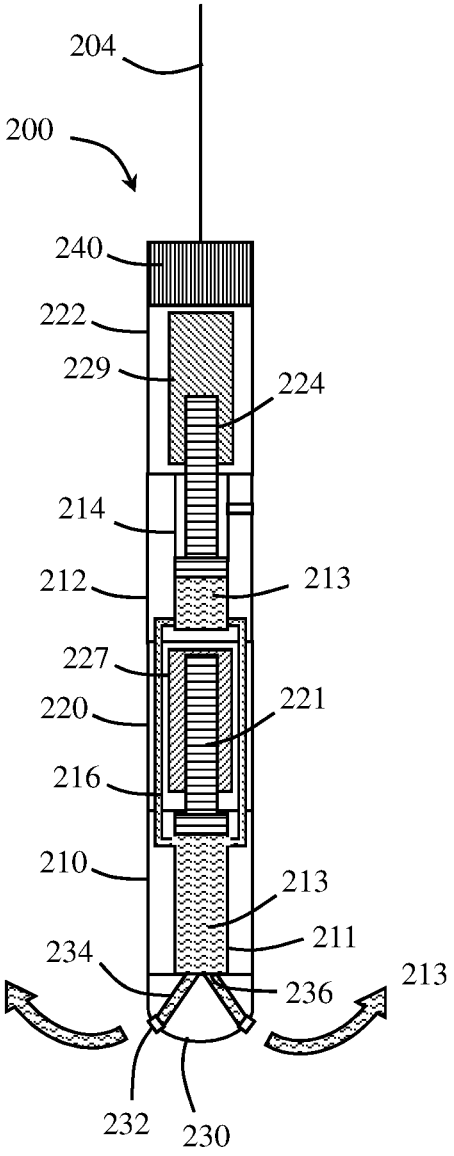
FIGS. 4 and 5 show operational phases of the bailer tool assembly shown in FIGS. 2 and 3.
Figure 5:
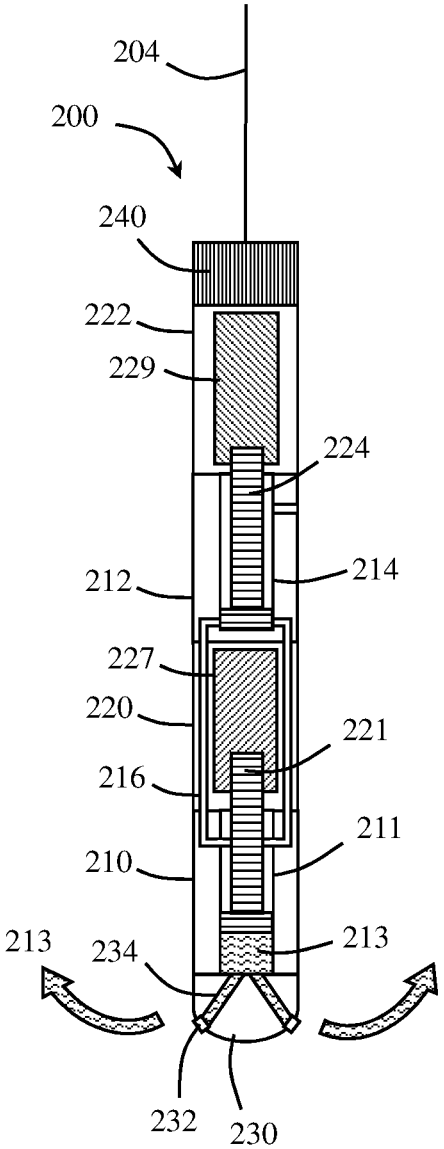

FIGS. 4 and 5 show an example of operational steps during an acid treatment using the bailer tool assembly 200 shown in FIGS. 2 and 3. The bailer tool assembly 200 may be filled with an acid mixture 213 through a fill port 218, to completely fill (or partially fill in some embodiments) each of the first and second fluid reservoirs 211, 214, as shown in FIG. 3. The fill port 218 may be closed after the fluid reservoirs 211, 214 are filled and lowered downhole on the attached wireline 204. After the acid mixture 213 has been jetted out of the bailer tool assembly 200 to perform the downhole acid treatment, the bailer tool assembly 200 may be brought back to the surface of the well. In some embodiments, the bailer tool assembly 200 may be refilled with an acid mixture 213 and sent back downhole to perform a second acid treatment. The process of filling and spraying an acid mixture with the bailer tool assembly 200 may be repeated until the acid treatment is complete.

As the bailer tool assembly 200 is lowered downhole, the depth indicator tool 240 may send instrument readings via electrical signals through the wireline 204 to the surface of the well, where they may be interpreted as depth readings. Based on the depth readings from the depth indicator tool 240, the bailer tool assembly 200 may be sent to a precise downhole location.

Once the bailer tool assembly 200 is in location, a command in the form of an electrical signal may be sent through the wireline 204 to the bailer tool assembly 200 to activate the electrically activated hydraulic chamber 229. As shown in FIG. 4, when activated, the electrically activated hydraulic chamber 229 may release a compressed hydraulic fluid to push the second piston 224 in a direction away from the second piston housing 222 an axial distance through the second fluid reservoir 214 in the second bailer 212. As the second piston 224 moves through the second fluid reservoir 214, the second piston 224 may push the acid mixture 213 in the second fluid reservoir 214 through the fluid bypass lines 216 and into the first fluid reservoir 211. As fluid flow of the acid mixture 213 continues to build pressure in the first fluid reservoir 211, the acid mixture 213 may be pushed through the flow paths 234 in the nozzle assembly 230 and jetted out of the rotatable nozzles 232.

In some embodiments, the acid mixture 213 may be prevented from flowing out of the rotatable nozzles 232 by a closure, such as a burst disc 236 or pressure relief valve, until the pressure build in the first fluid reservoir 211 bursts or opens the closure, thereby allowing fluid flow through the flow paths 234 and out the rotatable nozzles 232. In some embodiments, a valve may be opened, for example, by electric signal from the wireline 204, to allow fluid flow through the flow paths 234 and out the rotatable nozzles 232.

As shown in FIG. 5, once the second piston 224 extrudes the acid mixture 213 from the second fluid reservoir 214, the electrically activated hydraulic chamber 227 in the first piston housing 220 may be activated to move the first piston 221 through the first fluid reservoir 211 in the first bailer 210. As the first piston 221 is moved through the first fluid reservoir 211, the first piston 221 may push the acid mixture 213 out of the first fluid reservoir 211, through the flow paths 234 in the nozzle assembly 230, and out of the rotatable nozzles 232.

The rotatable nozzles 232 may be self-rotating and hydraulically rotatable from the acid mixture 213 flowing through the rotatable nozzle 232. For example, each rotatable nozzle 232 may be rotatably mounted in a bearing receptacle and include at least one fin or channel capable of rotating the rotatable nozzle 232 within its bearing receptacle as fluid flows around the fin or channel.

Figure 6:
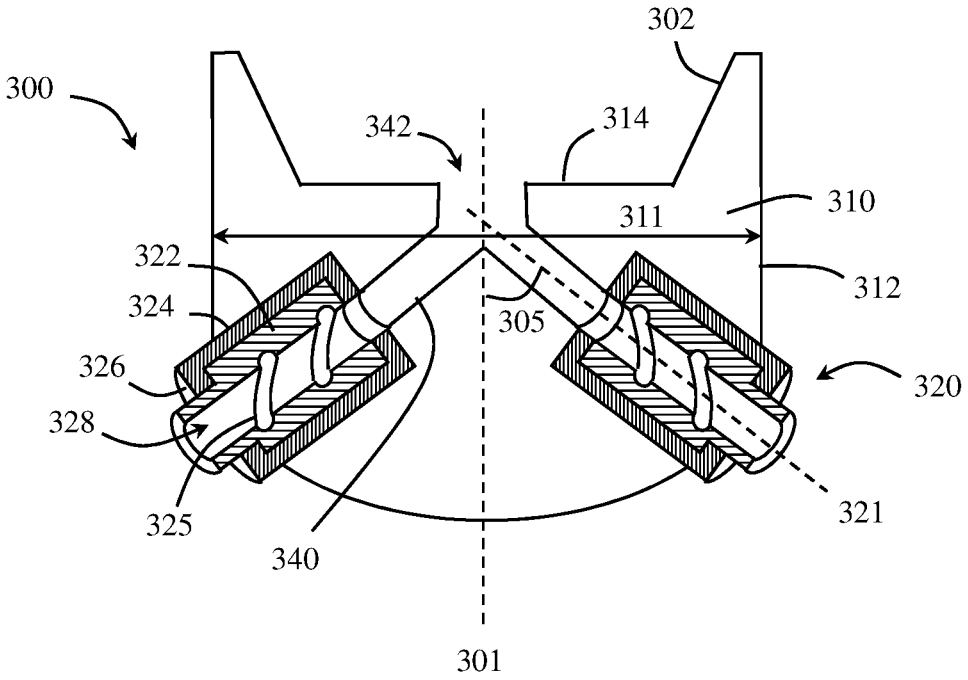
FIG. 6 shows a cross-sectional diagram of a nozzle assembly according to embodiments of the present disclosure.

FIG. 6 shows an example of a nozzle assembly 300 according to embodiments of the present disclosure. The nozzle assembly 300 may include a body 310 having a plurality of rotatable nozzles 320 positioned around its outer surface 312. In some embodiments, the rotatable nozzles 320 may be positioned around or close to an outer diameter 311 of the nozzle assembly 300 and oriented to direct fluid radially outward from the nozzle assembly 300. For example, a rotatable nozzle 320 may be oriented to direct fluid radially outward from the nozzle assembly 300 at an angle 305 from the nozzle assembly longitudinal axis 301 ranging from about 30 degrees to about 100 degrees.

A rotatable nozzle 320 may include a rotatable body 322 mounted in a bearing receptacle 324, where the rotatable body 322 is rotatable about its longitudinal axis 321 within the bearing receptacle 324. The bearing receptacle 324 may include one or more retention mechanisms, such as an outer lip 326, that holds the rotatable body 322 within the bearing receptacle 324 while also allowing the rotatable body 322 to rotate within the bearing receptacle 324. Each rotatable body 322 includes an interior flow path 328 extending along its longitudinal axis 321. According to embodiments of the present disclosure, one or more helical channels 325 may be formed along the interior flow path 328, where fluid flow through the interior flow path 328 flows through the helical channels 325 to rotate the rotatable body 322 within the bearing receptacle 324. In some embodiments, other types of flow directing elements, such as fins, may be formed along an interior flow path of a rotatable nozzle to rotate the nozzle as fluid flows therethrough.

Flow paths 340 may fluidly connect the interior flow path 328 of the nozzles 320 to one or more fluid inlets 342 formed at an upper surface 314 of the nozzle assembly 300. The fluid inlet 342 may be aligned with and fluidly connected to an outlet of a fluid reservoir in a bailer when the nozzle assembly 300 is attached to the bailer. For example, the nozzle assembly 300 may be attached to a bailer via a threaded connection 302, and when attached, the upper surface 314 of the nozzle assembly 300 may interface a lower surface of the bailer. The fluid inlet 342 of the nozzle assembly 300 may be designed to align with and seal against a corresponding fluid outlet formed in the lower surface of the bailer, such that once the nozzle assembly 300 is attached to the bailer, fluid may flow from the fluid outlet in the bailer through the fluid inlet 342 formed in the nozzle assembly 300.

As discussed above, fluid may be ejected out of fluid reservoirs in bailers using a motor-powered piston and/or a hydraulically powered piston, e.g., as shown in the embodiment of FIGS. 2 and 3. However, in some embodiments, one or more pistons without a power source may be used to push fluid out of a fluid reservoir in the bailer tool assembly. For example, pistons may be provided as weight bars (or dead weights) in a piston housing, which when released, may drop through one or more bailer fluid reservoirs to push fluid out of the bailers and through a nozzle assembly.

Figure 7:
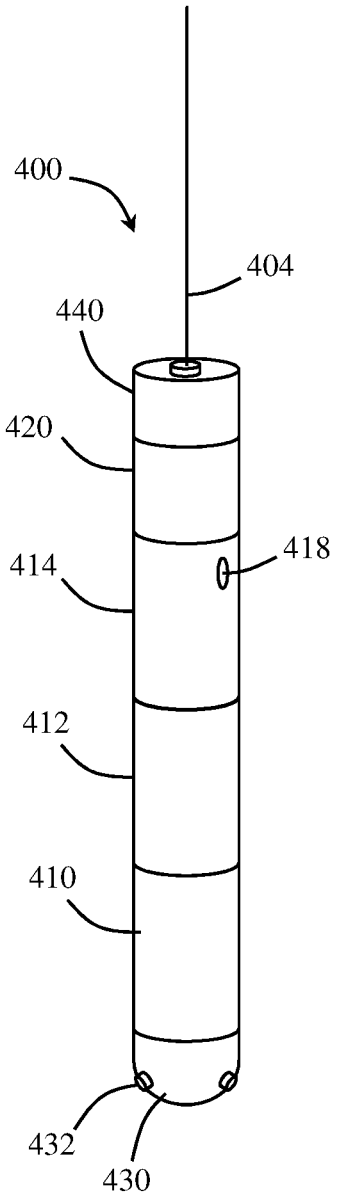
FIG. 7 shows a bailer tool assembly according to embodiments of the present disclosure.
Figure 8:
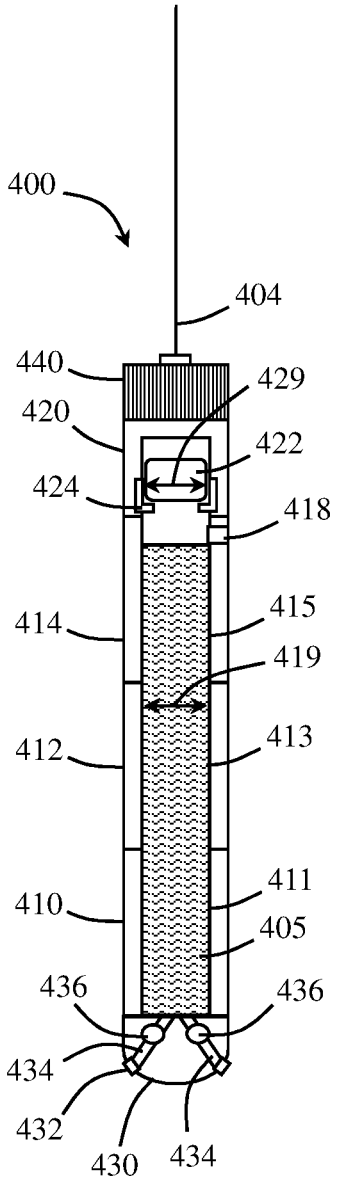
FIGS. 8 and 9 show cross-sectional views of the bailer tool assembly of FIG. 7 in different operational phases.
Figure 9:
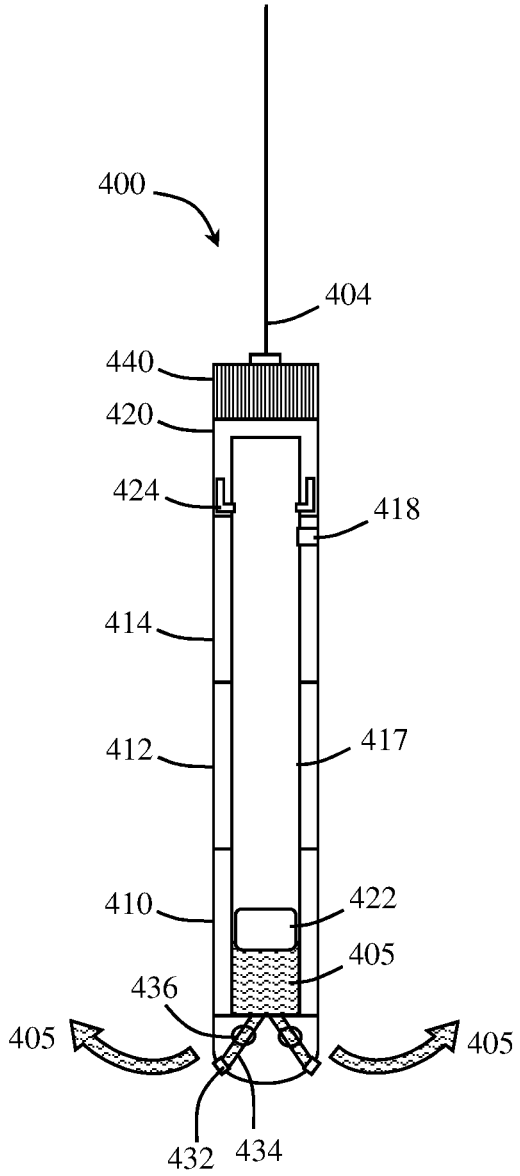

For example, FIGS. 7-9 show an example of a bailer tool assembly 400 having a piston in the form of a weight bar 422. As shown in FIG. 7, the bailer tool assembly 400 may have a generally tubular shape and include multiple axially connected bailers 410, 412, 414, a piston housing 420 attached at an upper end of the connected together bailers 410, 412, 414, where the weight bar 422 may be held inside the piston housing 420, and a nozzle assembly 430 attached at a lower end of the connected together bailers 410. A plurality of outwardly facing rotatable nozzles 432 may be positioned around the nozzle assembly 430 at a lower axial end of the bailer tool assembly 400. Further, a fill port 418 may be provided on the uppermost bailer 414, which may be used to fill the bailer tool assembly 400 with fluid 405 and seal in the fluid 405 during transport downhole.

FIGS. 8 and 9 show cross-sectional views along an axial plane of the bailer tool assembly 400 during different operational phases of the bailer tool assembly. In FIG. 8, a fluid 405 may be filled into the connected together bailers 410, 412, 414 through a fill port 418. The bailers may include a lowermost bailer 410, an intermediate bailer 412, and an uppermost bailer 414, where the nozzle assembly 430 is attached to a lower end of the lowermost bailer 410, and the piston housing 420 is attached to an upper end of the uppermost bailer 414. Each bailer 410, 412, 414 may have a fluid reservoir 411, 413, 415, respectively, for holding a fluid 405.

One or more valves 436 positioned between the fluid reservoirs and the nozzles 432 may be used to prevent the fluid 405 from flowing out of the bailer tool assembly 400 prior to the ejection process. For example, in the embodiment shown, valves 436 may be provided along flow paths 434 extending from the lowermost fluid reservoir 411 to rotatable nozzles 432 on the nozzle assembly 430. When the valves 436 are closed, as shown in FIG. 8, the fluid 405 may be retained in the fluid reservoirs. When the valves 436 are opened, as shown in FIG. 9, the fluid 405 may be ejected out of the bailer tool assembly 400 through the rotatable nozzles 432.

The fluid reservoirs 411, 413, 415 in each bailer may be configured such that when connected together, the fluid reservoirs 411, 413, 415 (collectively referenced 417) may form a continuous fluid reservoir 417 extending an axial length through the connected together bailers 410, 412, 414 and having a uniform inner diameter 419 along the axial length. A weight bar 422 held in the piston housing 420 may have an outer diameter 427 that extends to the inner diameter 419 of the fluid reservoirs 417, such that the weight bar 422 slides through the inner diameter 419 of the fluid reservoirs 417 without allowing fluid 405 to flow between the weight bar outer diameter 429 and fluid reservoir inner diameter 419.

As shown in FIG. 8, prior to ejecting the fluid 405 out of the bailer tool assembly 400, the weight bar 422 may be held within the piston housing 420 by a releasable support 424 in the piston housing 420. A releasable support 424 may include one or more retractable arms or blades that may retract from a radially interior position to within a piston housing wall. For example, when a releasable support 424 is in the radially interior position, the weight bar 422 may be on top of and supported by the releasable support 424. The weight bar 422 may be held by the releasable support 424 during filling the bailer tool assembly 400 with fluid 405 and during sending the bailer tool assembly 400 to a downhole location.

As shown in FIG. 9, the releasable support 424 may be moved radially outward toward the outer diameter of the piston housing 420 to release the weight bar 422. In some embodiments, the releasable support 424 may be retracted into a housing formed along the piston housing 420 wall. The releasable support 424 may be radially moved, for example, using a motor, one or more spring release mechanisms, and/or one or more magnets. The release mechanism may be activated using an electrical signal, which may be sent through the wireline 404. For example, in some embodiments, at least one magnet may be positioned between the releasable support 424 and the piston housing wall, where the magnet(s) may have a polarity that repels the releasable support 424 from the piston housing wall in a radially inward direction. To retract the magnetically held releasable support 424, an electrical signal may be sent through the wireline 404 to change the polarity of the magnet and pull the releasable support 424 toward the piston housing wall in a radially outward direction.

When the releasable support 424 is retracted into the piston housing wall, the releasable support 424 may move out from under the weight bar 422, thereby allowing the weight bar 422 to drop (from gravity). As the weight bar 422 drops and slides through the fluid reservoir 417, the weight bar 422 may exert a force on the fluid 405. At the same time or immediately after the weight bar 422 is released and dropped into the fluid reservoir 417, the valves 436 in the nozzle assembly 430 may be opened to allow the fluid 405 to be pushed out of the fluid reservoir 417 from the weight of the weight bar 422 to be ejected out of the rotatable nozzles 432.

In some embodiments, the valves 436 may be electrically activated to open. For example, the valves 436 may be in communication with the wireline 404, e.g., in wireless communication or in wired communication through one or more wires extending from a valve controller through the bailer tool assembly 400 to the wireline. When a signal is sent to release the weight bar 422, a signal may also be sent to open the valves 436. In embodiments having electrically activated valves 436, the activation mechanism may be powered, for example, by batteries. In some embodiments, the valves 436 may be pressure activated, where the valves 436 may open when the valve actuation mechanism is exposed to a pre-set pressure applied from the fluid 405 compressed by the released weight bar 422.

According to embodiments of the present disclosure, the dropping speed of the weight bar 422 and the rotatable nozzle(s) 432 may be designed to eject a fluid having a preselected flow rate out of the bailer tool assembly 400. For example, in some embodiments, designing the bailer tool assembly 400 may include simulating a bailer tool assembly having initial design parameters, including an initial size/weight of a weight bar 422, fluid type, volume of the bailer(s), and size, shape, and amount of rotatable nozzles 432. Ejection of the fluid from the bailer tool assembly may be simulated to determine the direction and flow rate of the fluid from the nozzles 432. Based on the simulation results, the initial design parameters of the bailer tool assembly may be changed to alter the direction and flow rate of the fluid being ejected from the bailer tool assembly 400. For example, to decrease the speed of the weight bar 422 drop, the flow rate through the nozzles 432 may be decreased (e.g., by designing the interior flow path through the nozzles to be relatively smaller), which may increase the back-pressure created from the nozzles and thereby decrease the drop speed of the weight bar 422.

A depth indicator tool 440 may be provided at an upper axial end of the bailer tool assembly 400, which may send depth reading measurements to the surface of the well as the bailer tool assembly 400 is sent downhole. For example, the depth indicator tool 440 may include a gamma ray unit that may send gamma readings taken from the surrounding downhole environment, which may be interpreted at the surface of the well. A depth indicator tool 440 may also include a casing collar locator, which may send readings such as electrical disruptions that indicate when the depth indicator tool 440 moves past a change in casing shape (e.g., from a casing collar).

By using the depth indicator tool 440 to determine the position of the bailer tool assembly 400 in a well, the bailer tool assembly 400 may be able to more accurately spray a selected area of the well with the fluid 405 when compared with methods of sending bailer tools downhole relying on the relationship between depth and the rate at which the bailer string is sent downhole.

Bailer tool assemblies according to embodiments disclosed herein may be used to perform an acid treatment, such as acid washing a section of a well. Methods of acid washing may include sending a bailer tool assembly according to embodiments of the present disclosure down a well on a wireline or slickline, and using a depth indicator tool integrated into the bailer tool assembly to continuously monitor the depth of the bailer tool assembly until the bailer tool assembly reaches a selected downhole location. The bailer tool assembly may include, for example, a first bailer having a first fluid reservoir, a first piston positioned at an axial end of the first bailer and slidable through the first fluid reservoir, a plurality of rotatable nozzles positioned at an opposite axial end of the first bailer from the first piston, and a position indicator selected from at least one of a gamma ray device and a casing collar locator. The bailer tool assembly may also include a first motor positioned proximate to and powering the first piston. In embodiments where the bailer tool assembly includes multiple bailers (e.g., a first and second bailer each having an associated piston positioned next to and slidable through the bailer fluid reservoirs), multiple motors may be used to power each piston associated with different bailers (e.g., including a second motor positioned proximate to and powering a second piston). For example, as shown in FIG. 3, a first motor 292 may be positioned next to and power the first piston 221, and a second motor 290 may be positioned next to and power the second piston 224.

To continuously monitor the depth of the bailer tool assembly as it is sent downhole, location signals (e.g., in the form of gamma readings and electrical signals from a casing collar locator) may be continuously (e.g., at set time intervals) sent from the bailer tool assembly to the surface of the well to be analyzed and interpreted. The signals may be sent from the position indicator, for example, through an electric cable running along a wireline sending the bailer tool assembly downhole, through an electrically conducting path along a slickline sending a bailer tool assembly downhole, or wirelessly using one or more transmitters.

Based on the received and analyzed location signals from the position indicator as the bailer tool assembly is sent down the well, the bailer tool assembly may be positioned at a downhole location. Upon reaching the downhole location, the bailer tool assembly may be activated to eject an amount of the contained fluid. For example, one or more pistons may be activated to slide through one or more fluid reservoirs to push an acid out of the fluid reservoir(s) and through the plurality of rotatable nozzles. Fluid may be ejected from a bailer tool assembly through a plurality of nozzles that are self-rotating and hydraulically rotated when the fluid flows through the nozzles.

The bailer tool assembly may be activated to eject fluid using one or more electrical signals sent through the wireline or slickline sending the bailer tool assembly downhole. For example, a piston may be electrically activated from one or more signals sent through the wireline or slickline to move the piston through one or more fluid reservoirs to eject stored fluid.

After pushing fluid out of one or more fluid reservoirs in the bailer tool assembly, the bailer tool assembly may be brought back to the surface of the well. At the surface, the bailer tool assembly may be refilled with either the same or different fluid. For example, a fill port to one or more fluid reservoirs in the bailer tool assembly may be opened, and an acid may be filled into the one or more fluid reservoirs that is the same as the acid ejected in a previous run.

Multiple bailer tool assembly runs may be performed according to embodiments of the present disclosure until an acid treatment operation is complete. Further, bailer tool assemblies according to embodiments of the present disclosure may be used for multiple different acid treatment operations. For example, a bailer tool assembly according to embodiments of the present disclosure may be used for an acid treatment in one well and either the same or different type of acid treatment in a different well.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A system for acid treating a section of a well, comprising:

a wireline or slickline extending from a surface of the well into the well;

a bailer tool assembly attached to an end of the wireline or slickline, the bailer tool assembly comprising:

a first piston positioned in a first piston housing at an axial end of at least one bailer, the first piston being slidable through the at least one bailer;

a nozzle assembly positioned at a lower end of the bailer tool assembly and fluidly connected to a fluid reservoir containing acid in the at least one bailer, wherein the nozzle assembly comprises at least one rotatable nozzle;

wherein the at least one rotatable nozzle comprises an interior flow path extending therethrough, and wherein the at least one rotatable nozzle is rotatable about an axis extending along the interior flow path; and a depth indicator tool comprising at least one of a casing collar locator and a gamma ray unit attached to an upper end of the bailer tool assembly.

2. The system of claim 1, wherein a fill port is fluidly connected to the fluid reservoir.

3. The system of claim 1, wherein the first piston is powered by an electrically activated hydraulic chamber.

4. The system of claim 1, wherein the first piston is powered by an electric motor.

5. The system of claim 1, wherein the at least one rotatable nozzle is self-rotating and hydraulically rotatable from fluid flowing through the at least one rotatable nozzle, and wherein the axis is oriented at an angle from a longitudinal axis of the bailer tool assembly.

6. The system of claim 1, wherein the bailer tool assembly is attached to the end of the wireline, wherein an electrical cable runs from the bailer tool assembly, along the wireline, to the surface of the well.

7. The system of claim 1, wherein the at least one bailer comprises:

a first bailer positioned axially between the nozzle assembly and the first piston housing;

a second bailer positioned axially adjacent to the first piston housing opposite the first bailer; and a bypass line extending around the first piston housing to fluidly connect the first bailer and the second bailer;

wherein a second piston provided in a second piston housing is at an opposite axial end of the second bailer from the first piston housing; and wherein the second piston is slidable through the second bailer.

8. The system of claim 7, further comprising a first motor positioned proximate to and powering the first piston and a second motor positioned proximate to and powering the second piston.

9. The system of claim 1, wherein the first piston is a weight bar releasably held by a support in the first piston housing.

10. A downhole tool assembly, comprising:

a first bailer comprising a first fluid reservoir containing acid;

a first piston positioned at an axial end of the first bailer and slidable through the first fluid reservoir, wherein the first piston is a weight bar releasably held by a support;

a plurality of nozzles positioned at an opposite axial end of the first bailer from the first piston; and a position indicator selected from at least one of a gamma ray device and a casing collar locator.

11. The tool assembly of claim 10, further comprising a second bailer threadably connected to the first bailer at an opposite axial end from the support, wherein the second bailer comprises a second fluid reservoir.

12. The tool assembly of claim 10, wherein the support is activated to release the weight bar by a connected electric activation mechanism.

13. A method of acid treating a section of a well, comprising:

sending a bailer tool assembly down a well on a wireline or slickline, the bailer tool assembly comprising:

a first bailer comprising a first fluid reservoir;

a first piston positioned at an axial end of the first bailer and slidable through the first fluid reservoir;

a plurality of rotatable nozzles positioned at an opposite axial end of the first bailer from the first piston, wherein the plurality of rotatable nozzles have at least one helical channel formed along an interior flow path of each rotatable nozzle, such that the plurality of rotatable nozzles are self-rotating and hydraulically rotated when the acid flows through the rotatable nozzles; and a position indicator selected from at least one of a gamma ray device and a casing collar locator;

receiving location signals from the position indicator as the bailer tool assembly is sent down the well;

positioning the bailer tool assembly at a downhole location based on the location signals; and activating the first piston to slide through the first fluid reservoir to push an acid out of the first fluid reservoir and through the plurality of rotatable nozzles.

14. The method of claim 13, wherein an electric cable runs along the wireline, and wherein the location signals are sent from the position indicator through the electric cable.

15. The method of claim 14, wherein the first piston is electrically activated through the electric cable.

16. The method of claim 13, after pushing the acid out of the first fluid reservoir, further comprising:

bringing the bailer tool assembly to a surface of the well;

opening a fill port to the first fluid reservoir; and filling the first fluid reservoir with a second acid through the fill port.

17. The method of claim 13, wherein the bailer tool assembly further comprises:

a second bailer positioned on an opposite side of the first piston from the first bailer, the second bailer comprising a second fluid reservoir;

a second piston positioned at an opposite axial end of the second bailer from the first piston; and at least one bypass line extending between and fluidly connected to the first fluid reservoir and the second fluid reservoir;

wherein the second piston is electrically activated to push a second acid from the second fluid reservoir through the at least one bypass line to the first fluid reservoir; and wherein the first piston is activated independently from the second piston after the second piston pushes the second acid out of the second fluid reservoir.

18. A downhole tool assembly, comprising:

a first bailer comprising a first fluid reservoir containing acid;

a first piston positioned at an axial end of the first bailer and slidable through the first fluid reservoir;

a first motor positioned proximate to and powering the first piston;

a plurality of nozzles positioned at an opposite axial end of the first bailer from the first piston;

a second bailer positioned on an opposite side of the first piston from the first bailer, the second bailer comprising a second fluid reservoir;

a second piston positioned at an opposite axial end of the second bailer from the first piston;

a second motor positioned proximate to and powering the second piston;

at least one bypass line extending between and fluidly connected to the first fluid reservoir and the second fluid reservoir; and a position indicator selected from at least one of a gamma ray device and a casing collar locator.

* * * * *